US006963310B2

(12) United States Patent
Horita et al.

(10) Patent No.: US 6,963,310 B2
(45) Date of Patent: Nov. 8, 2005

(54) MOBILE PHONE ANTENNA

(75) Inventors: Hitoshi Horita, Tokyo (JP); Takahiro Sugiyama, Tokyo (JP); Shin Kataoka, Tokyo (JP); Shinichi Takaba, Tokyo (JP)

(73) Assignee: Hitachi Cable, Ltd., Tokyo (JP)

( * ) Notice: Subject to any disclaimer, the term of this patent is extended or adjusted under 35 U.S.C. 154(b) by 6 days.

(21) Appl. No.: 10/656,883

(22) Filed: Sep. 8, 2003

(65) Prior Publication Data

US 2004/0130493 A1 Jul. 8, 2004

(30) Foreign Application Priority Data

Sep. 9, 2002 (JP) ..... 2002-262928

(51) Int. Cl.[7] ..... H01Q 1/36; H01Q 1/24
(52) U.S. Cl. ..... 343/702; 343/700 MS
(58) Field of Search ..... 343/702, 700 MS, 343/895, 866, 846

(56) References Cited

U.S. PATENT DOCUMENTS 6,011,519 A * 1/2000 Sadler et al. ..... 343/742
6,031,503 A * 2/2000 Preiss et al. ..... 343/770
6,466,176 B1 * 10/2002 Maoz et al. ..... 343/767
6,693,604 B2 * 2/2004 Washiro et al. ..... 343/895
6,806,835 B2 * 10/2004 Iwai et al. ..... 343/702
2002/0021250 A1 * 2/2002 Asano et al. ..... 343/702
2002/0149525 A1 10/2002 Mitsui
2003/0137459 A1 * 7/2003 Kim et al. ..... 343/702
2003/0179143 A1 * 9/2003 Iwai et al. ..... 343/702
2004/0027298 A1 * 2/2004 Iguchi et al. ..... 343/702
2004/0125029 A1 * 7/2004 Maoz et al. ..... 343/702

FOREIGN PATENT DOCUMENTS

JP 7-7321 A 1/1995
JP 9-93029 A 4/1997
JP 2002-344231 A 11/2003

* cited by examiner

*Primary Examiner*—Wilson Lee
*Assistant Examiner*—Hung Tran Vy
(74) *Attorney, Agent, or Firm*—Foley & Lardner LLP

(57) ABSTRACT

A mobile phone antenna has: a first conductive radiation element that is formed in a sheet metal conductor and resonates at a predetermined resonance frequency; a second conductive radiation element that is formed in the sheet metal conductor and resonates at the predetermined resonance frequency; and a ground that is connected through a conductive ground connector with the second conductive radiation element. The ground is placed such that the ground is not opposed to the first and second conductive radiation elements.

11 Claims, 6 Drawing Sheets

MOBILE PHONE ANTENNA

The present application is based on Japanese patent application No.2002-262928, the entire contents of which are incorporated herein by reference.

BACKGROUND OF THE INVENTION

1. Field of the Invention

This invention relates to a mobile phone antenna and, particularly, to a mobile phone antenna that the bandwidth can be broadened without raising the position of an antenna element and that can prevent displacement in resonance frequency in a folding type mobile phone where the position of a board ground is shifted when folded.

2. Description of the Related Art

Mobile phones and PHS (personal handyphone system) phones are provided with a telescoping whip antenna and a built-in planar antenna so as to facilitate the receiving and transmitting with the base station. The planar antenna used is generally inverted F antenna that has a miniaturized size, a simplified structure and broad bandwidth characteristics.

FIG. 1 is a perspective view showing a conventional inverted F antenna for mobile phone. The inverted F antenna 100 for mobile phone is provided with a ground plane 101 as a printed circuit board which is installed in the housing of mobile phone, and the ground plane 101 is composed of interconnection pattern and metal conductors. Above the ground plane 101, there is provided a planar antenna radiation element 102 of metal plate. Further, a ground connector 103 and a feed point 104 are provided to connect the ground plane 101 with the antenna radiation element 102.

However, in the convention inverted F antenna, it is necessary to raise, by a certain height, the antenna element 102 from the ground plane 101 since the bandwidth narrows according as the antenna element 102 comes closer to the ground plane 101. Furthermore, since the inverted F antenna is apt to be affected by the ground of printed circuit board (board ground), there occurs a displacement in resonance frequency when the position of board ground varies as the upper and lower housings are opened or closed that are equipped with a folding type mobile phone.

SUMMARY OF THE INVENTION

It is an object of the invention to provide a mobile phone antenna that the bandwidth can be broadened without raising the position of antenna element and that can prevent displacement in resonance frequency in a folding type mobile phone where the position of board ground is sifted when folded.

According to one aspect of the invention, a mobile phone antenna, comprises:

a first conductive radiation element that is formed in a sheet metal conductor and resonates at a predetermined resonance frequency;

a second conductive radiation element that is formed in the sheet metal conductor and resonates at the predetermined resonance frequency;

a ground that is connected through a conductive ground connector with the second conductive radiation element;

wherein the ground is placed such that the ground is not opposed to the first and second conductive radiation elements.

According to another aspect of the invention, a mobile phone antenna for folding type mobile phone with a pair of housings foldable, comprises:

a first ground that is installed in one of the pair of housings;

a second ground that is installed in the other of the pair of housings, the second ground being connected through a conductive inter-ground connector with the first ground;

first and second conductive radiation elements that are disposed at a position where the first and second conductive radiation elements are not opposed to the first and second ground, the first and second conductive radiation element resonating at a predetermined resonance frequency; and a conductive ground connector that electrically connects the first ground with the second conductive radiation element.

In the mobile phone antenna according to the invention, the second conductive radiation element functions as a ground and, therefore, it is not necessary for a ground such as printed circuit board and electronic parts to be placed under or near the conductive radiation element (antenna element). Namely, it is not necessary to raise the conductive radiation element from the ground. Hence, the antenna can offer a broadened bandwidth and prevent displacement in resonance frequency.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Figure 2A:
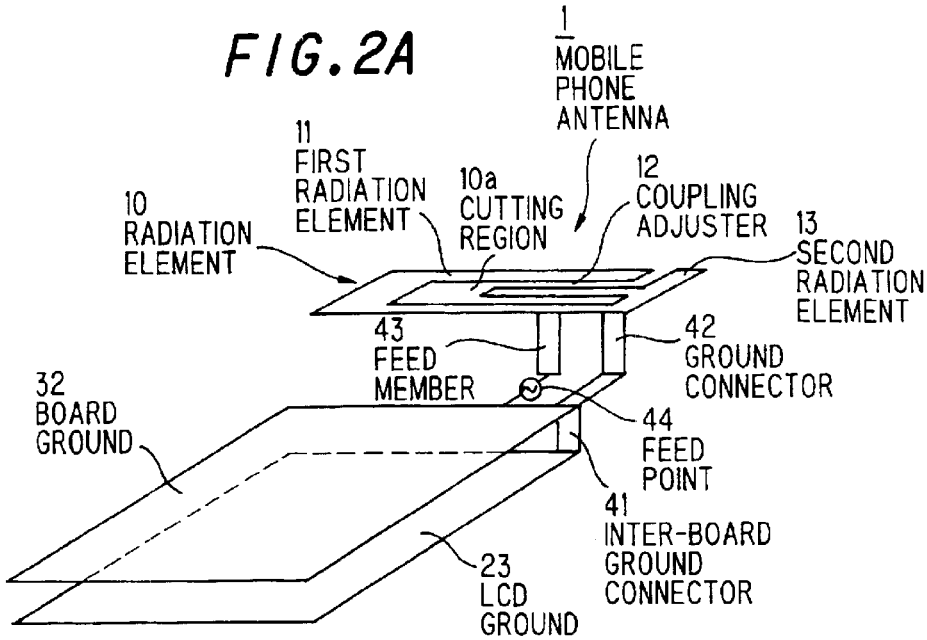
FIG. 2A is a perspective view showing a mobile phone antenna in a first preferred embodiment according to the invention.
Figure 2B:
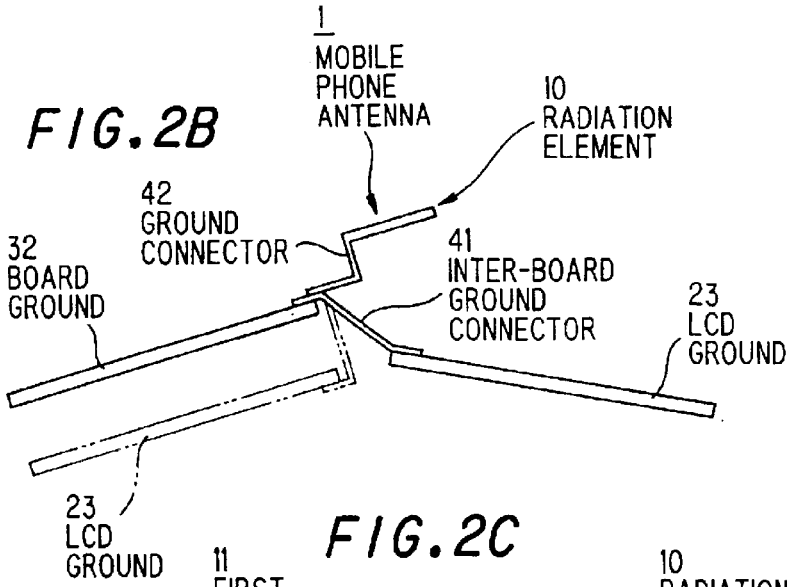
FIG. 2B is a side view illustrating the opened state of a LCD ground 23 in FIG. 2A.
Figure 2C:
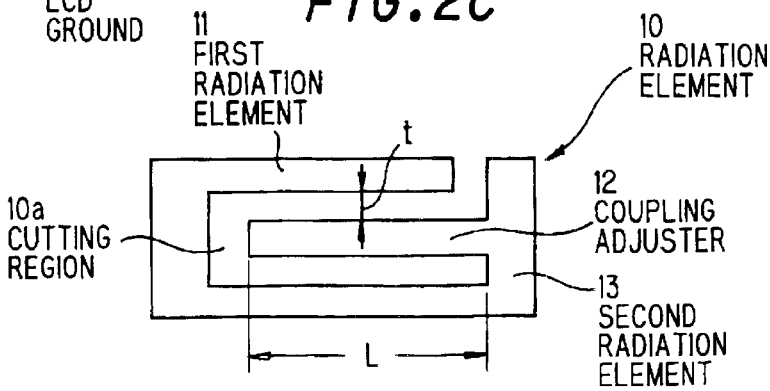
FIG. 2C is a plain view showing the main part of the mobile phone antenna in FIG. 2A.

FIG. 2A is a perspective view showing a mobile phone antenna in the first preferred embodiment according to the invention. FIG. 2B is a side view illustrating the opened state of a LCD ground 23 in FIG. 2A. FIG. 2C is a plain view showing the main part of the mobile phone antenna in FIG. 2A.

As shown in FIG. 2A, the mobile phone antenna includes a radiation element 10 that resonates at a predetermined frequency, a board ground 32, and a LCD ground 23. The radiation element 10 is connected through a ground connector 42 with the board ground 32. The board ground 32 is connected through an inter-board ground connector 41 with LCD ground 23 such that the LCD ground 23 can be opened (FIG. 2B). The radiation element 10 is provided with a strip-shaped feed member 43 that is disposed adjacent to the ground connector 42 and suspends vertically from radiation element 10. A feed point 44 lies between the lower end of the feed member 43 and the board ground 32.

The radiation element 10 is, as shown in FIG. 2C, composed of: a first radiation element 11 which is, as a whole, U-shaped and strip part at one end of which forms main part; a coupling adjuster 12 that is placed adjacent to the first radiation element 11 and extends from the opposite direction to the first radiation element 11; a strip-shaped second radiation element 13 that is connected with the first radiation element 11 and the coupling adjuster 12, wherein there is provided a cutting region 10*a* between the first radiation element 11 and the coupling adjuster 12 to form a planar antenna.

The inter-board ground connector 41 is of a material that can endure a number of folding cycles since it is subject to a stress in opening and closing of the LCD ground 23 when it is applied to a folding type mobile phone. The inter-board ground connector 41 connects the board ground 32 and the LCD ground 23 on the second radiation element 13 side. This reduces an influence caused by ground in opening and closing.

The ground connector 42 is, as shown in FIG. 2A, L-shaped and connected with one end of the second radiation element 13, and its one end (lower end) is connected with a corner of the board ground 32.

The radiation element 10 has, by itself, a function needed to operate as antenna by the first and second radiation elements 11, 13 and the coupling adjuster 12 as shown in FIG. 2A. Therefore, it is not necessary to provide the board ground 32 and the LCD ground 23 under the antenna. Thus, the radiation element 10 can be in such a state that it floats, in relation to high frequency, from the board ground 32, LCD ground 23 and the other ground (external ground etc.). In other words, it can be in a state of being not connected in relation to high frequency. "state of being not connected in relation to high frequency" means that the radiation element 10 does not have a conduction portion to be always at the same potential as ground. Namely, when the mobile phone antenna 1 is installed in a mobile phone, the radiation element 10 is electrically connected with a high-frequency circuit (e.g., receive and transmit circuit) of the mobile phone only through the interconnection through the feed member 43 with feed point 44 and through the ground connector 42 with the board ground 32. The radiation element 10 does not contact the other ground and is not connected directly with that, so that it lies independently.

In the first embodiment, the radiation element 10 is provided with the coupling adjuster 12 and, therefore, the resonance frequency ($\approx\lambda/4$) and bandwidth of antenna 1 can be adjusted to a desired value by changing a clearance (t) between the first radiation element 11 and the coupling adjuster 12 and a length (L) of the coupling adjuster 12. Meanwhile, clearance (t) is preferably 2 mm or less. The radiation element 10, ground connector 42 and feed member 43 may be integrally manufactured by punching or etching. Thereby, the number of parts can be reduced.

Figure 3:
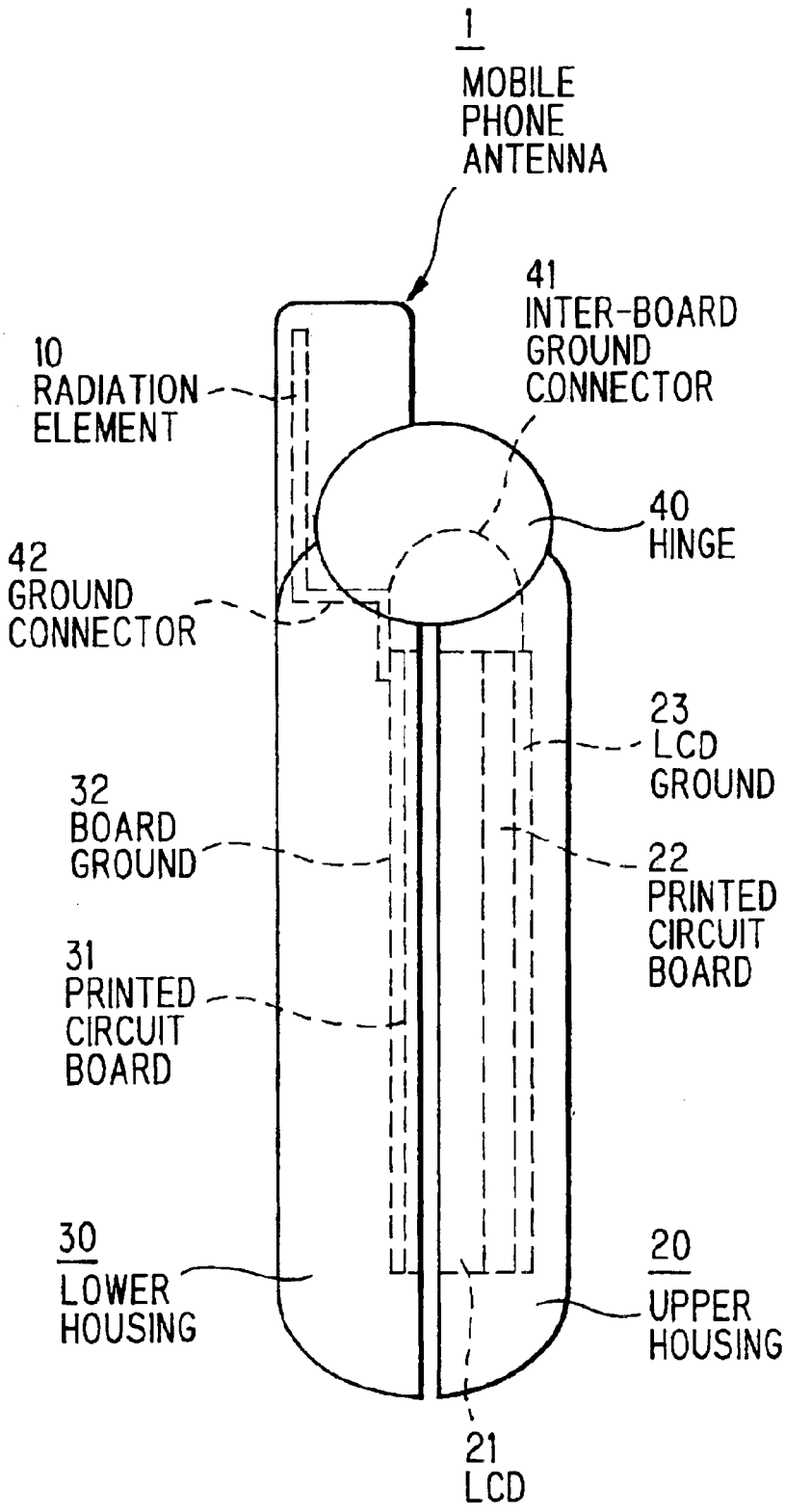
FIG. 3 is a side view showing the schematic composition of a folding type mobile phone installing the mobile phone antenna of the first embodiment.

FIG. 3 is a side view showing the schematic composition of a folding type mobile phone installing the mobile phone antenna of this embodiment. The folding type mobile phone includes a speaker (not shown), an upper housing 20 on which a liquid crystal display (LCD) is mounted, and a lower housing 30 that has an operation part with numeral keys and cursor keys, a microphone, earphone jack, charging terminal etc. The upper housing 20 is engaged rotatably around a hinge 40 with the lower housing 30. The mobile phone antenna 1 is installed in the upper housing 20 and the lower housing 30.

The upper housing 20 houses the LCD 21, a printed circuit board 22 mounted on the back side of LCD 21, and the LCD ground 23 provided on the back side of the printed circuit board 22.

The lower housing 30 houses a printed circuit board 31 with the board ground 32. The upper housing 20 can have an angle from zero in shut state to about 150 in opened state with reference to the lower housing 30 around the hinge 40. Although the radiation element 10 is electrically connected with the lower housing 30, they are not integrated mechanically and therefore they are movable to each other.

Figure 4A:
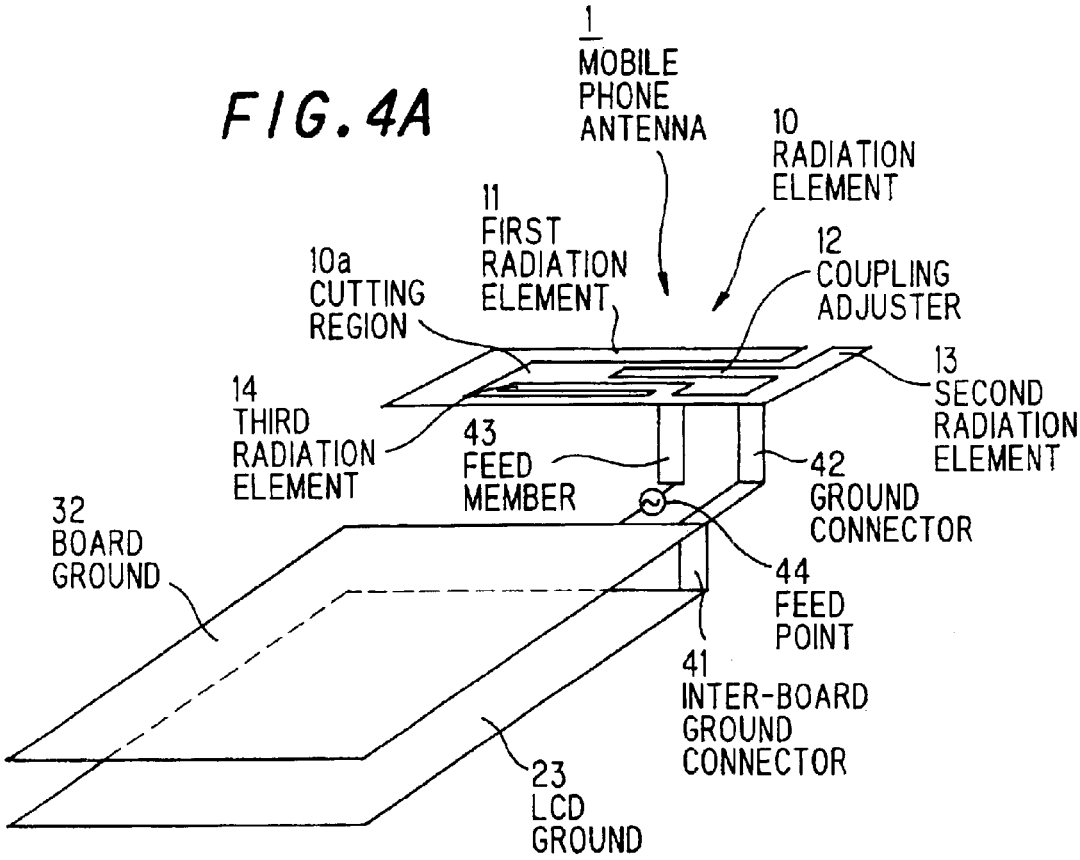
FIG. 4A is a perspective view showing a mobile phone antenna in a second preferred embodiment according to the invention.
Figure 4B:
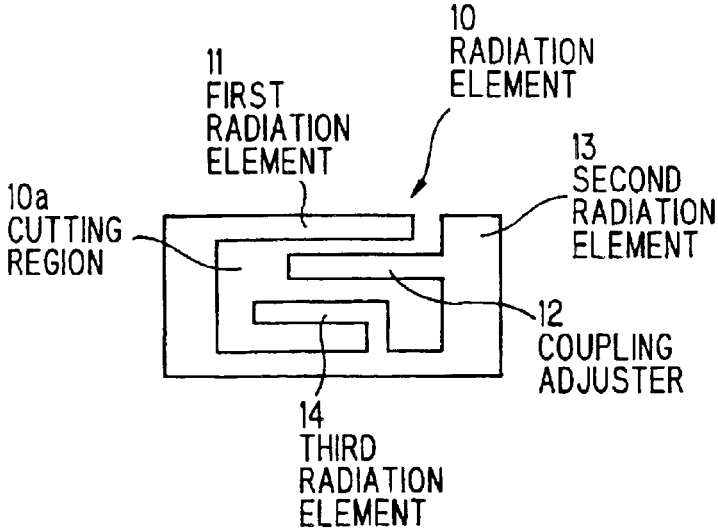
FIG. 4B is a plain view showing the main part of the mobile phone antenna in FIG. 4A.

FIG. 4A is a perspective view showing a mobile phone antenna in the second preferred embodiment according to the invention. FIG. 4B is a plain view showing the main part of the mobile phone antenna in FIG. 4A.

The mobile phone antenna 1 of the second embodiment is applied to a folding type mobile phone as that in the first embodiment. As shown in FIG. 4B, in the second embodiment, a third radiation element 14 is added as comparing to the mobile phone antenna 1 of the first embodiment. The other components are the same as those of the first embodiment.

The L-shaped third radiation element 14 is disposed such that it protrudes inside the first radiation element 11 near the feed point. Thus, the third radiation element 14 is, as shown in FIG. 4A, on the same plane as the first radiation element 11, coupling adjuster 12 and second radiation element 13.

In the mobile phone antenna 1 of the second embodiment, a first resonance frequency is determined by the first and second radiation elements 11, 13 and a second resonance frequency is determined by the second and third radiation elements 13, 14. Therefore, it is made to be multiband as compared to the mobile phone antenna of the first embodiment. Also, it can offer a broadened band like that of the first embodiment, and it can prevent displacement in resonance frequency due to opening and closing of the housing.

Figure 5:
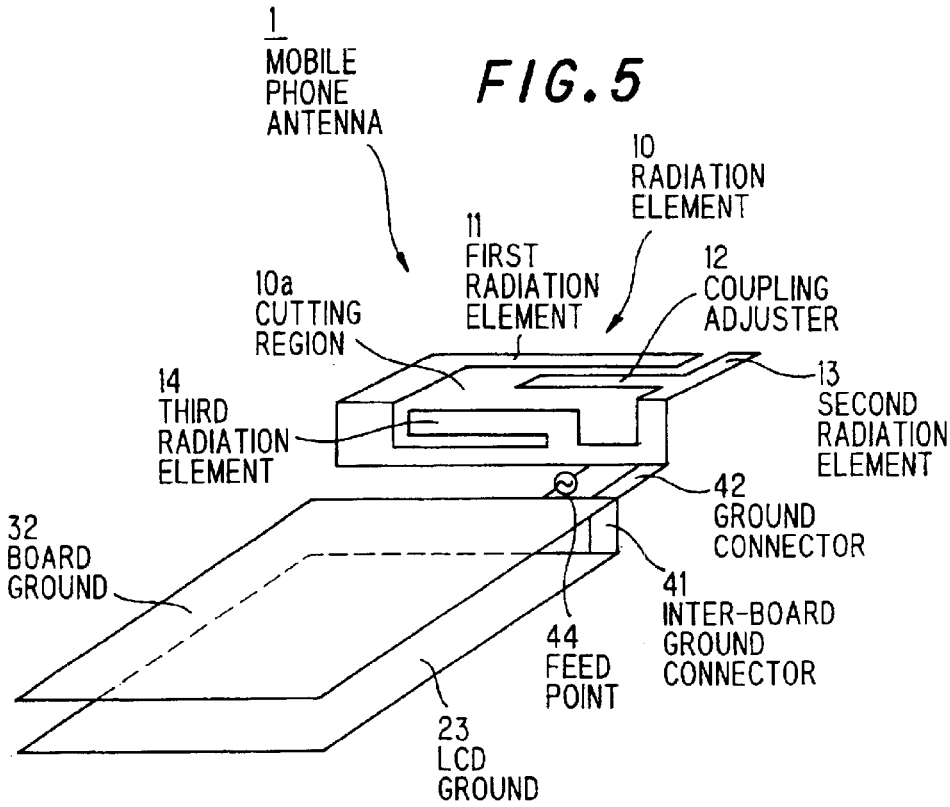
FIG. 5 is a perspective view showing a mobile phone antenna in a third preferred embodiment according to the invention.

FIG. 5 is a perspective view showing a mobile phone antenna in the third preferred embodiment according to the invention.

The mobile phone antenna 1 of the third embodiment is applied to a folding type mobile phone as that in the first embodiment. As shown in FIG. 5, in the third embodiment, the third radiation element 14 of the second embodiment is folded at right angles to the other parts and the feed member 43 thereof is omitted. The other components are the same as those of the second embodiment.

In the mobile phone antenna 1 of the second embodiment, electromagnetic waves can be radiated from the side. Also, it can be multiband and miniaturized while offering a broadened band, and it can prevent displacement in resonance frequency due to opening and closing of the housing.

Figure 1:
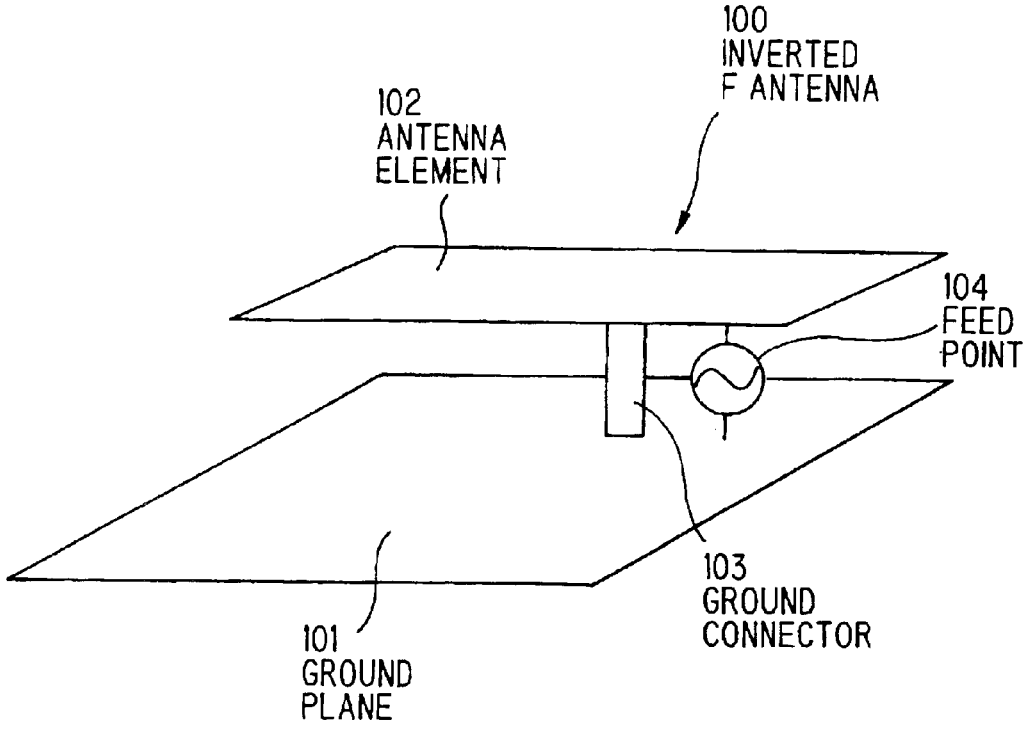
FIG. 1 PRIOR ART
FIG. 1 is a perspective view showing the conventional inverted F antenna for mobile phone.
Figure 6:
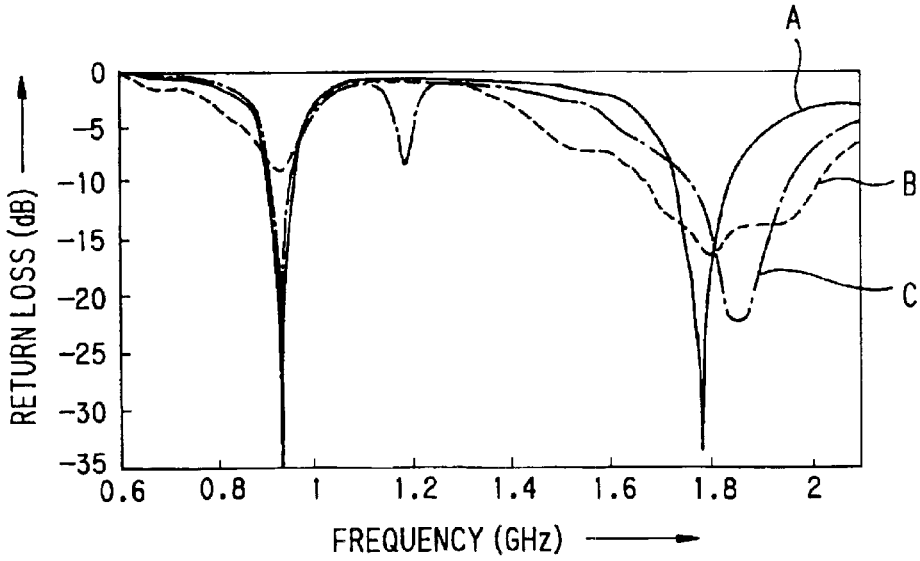
FIG. 6 is a graph showing return loss comparison between the mobile phone antenna of the third embodiment and a comparative example (conventional inverted F dual antenna in FIG. 1)

FIG. 6 is a graph showing return loss comparison between the mobile phone antenna of the third embodiment and a comparative example (conventional inverted F dual antenna in FIG. 1). In FIG. 6, A represents characteristics of the comparative example, B represents characteristics of the mobile phone antenna of the third embodiment in the opened state of folding type mobile phone, and C represents characteristics of the mobile phone antenna of the third embodiment in the closed state of folding type mobile phone.

Table 1 shows specific bandwidth comparison in VSWR= 3. In Table 1, GSM stands for global system for mobile communication system and 800 MHz band (870 to 960 MHz) is used in GSM band. DCS stands for digital cellular system and 1.7 GHz band (1710 to 1880 MHz) is used in DCS band.

TABLE 1

| Characteristic | Specific bandwidth (GSM band) in VSWR = 3 | Specific bandwidth (DCS band) in VSWR = 3 |
|---|---|---|
| A | 7.3% | 10.2% |
| B | 10.6% | 33.2% |
| C | 10.2% | 20.7% |

As shown in FIG. 6 and Table 1, the mobile antenna (B, C) of the third embodiment is enhanced by about 3% in specific bandwidth at GSM band and by about 10 to 23% in specific bandwidth at DCS band as compared to that of the conventional inverted F dual antenna (A). Also, there occurs little displacement in resonance frequency due to opening and closing of the hosing of mobile phone.

As described above, the mobile phone antenna of the third embodiment can offer a broadened band both at GSM and DCS band and prevent displacement in resonance frequency due to opening and closing of the housing even when it is installed in a mobile phone.

Figure 7:
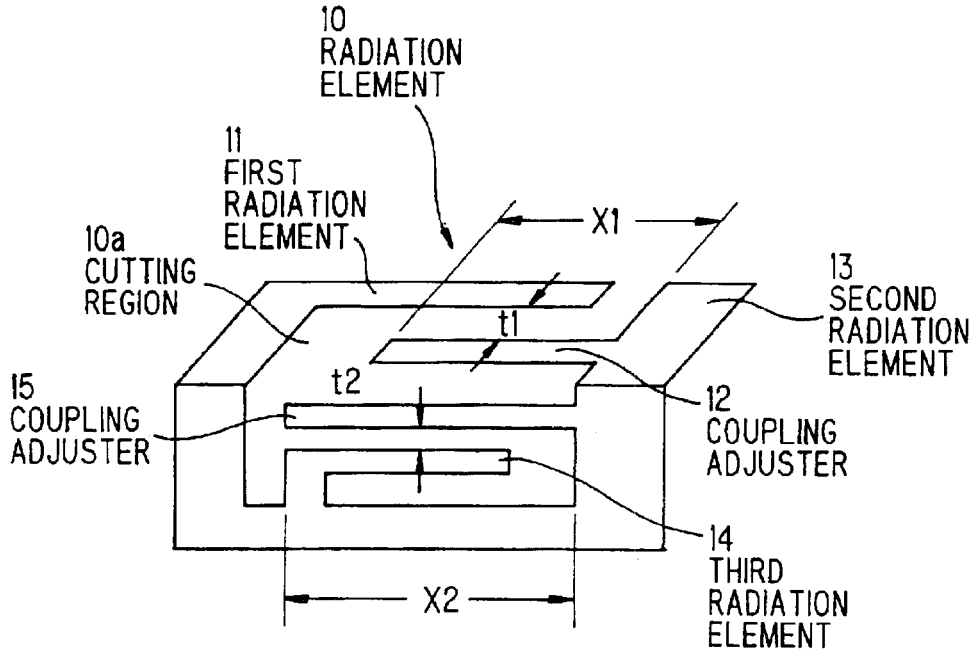
FIG. 7 is a perspective view showing a radiation element in a fourth preferred embodiment according to the invention.

FIG. 7 is a perspective view showing a radiation element in the fourth preferred embodiment according to the invention. In the fourth embodiment, it is intended to prevent displacement in resonance frequency both at GSM band and DCS band. Thus, there is provided a strip-shaped coupling adjuster 15, on the side face of the radiation element 10, between the third radiation element 14 and coupling adjuster 12 in the third embodiment in FIG. 5 and parallel to them. The other components are the same as those of third embodiment. The mobile phone antenna of the fourth embodiment can be integrally manufactured by punching or etching, like the first embodiment. Also, in this antenna, a first resonance frequency is determined by the first and second radiation elements 11, 13 and a second resonance frequency is determined by the second and third radiation elements 13, 14. The first and second resonance frequencies can be adjusted by the length X1 of the coupling adjuster 12 on the top face, the length X2 of the coupling adjuster 15 on the side face, the clearance t1 between the first radiation element 11 and the coupling adjuster 12 on the top face and the clearance t2 between the third radiation element 14 and the coupling adjuster 15 on the side face. Hence, this can prevent displacement in DCS band and displacement in resonance frequency both in GSM band and DCS band. Also, the bandwidth at each wavelength band can be adjusted.

Figure 8:
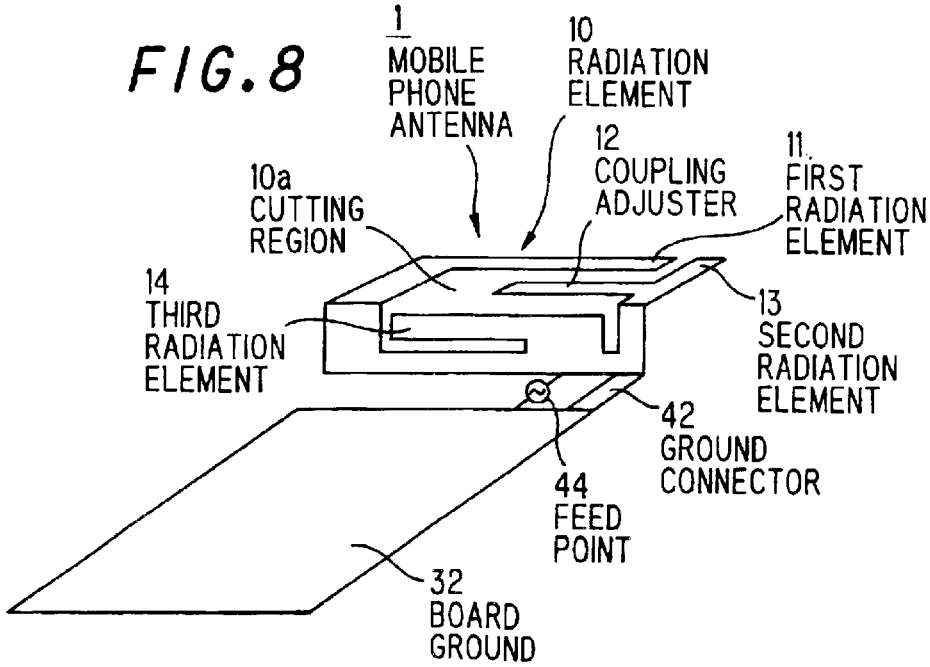
FIG. 8 is a perspective view showing a mobile phone antenna in a fifth preferred embodiment according to the invention.

FIG. 8 is a perspective view showing a mobile phone antenna in the fifth preferred embodiment according to the invention. The mobile phone antenna of the fifth embodiment is applied to mobile phones other than folding type mobile phone. It is composed such that the LCD ground 23 and the inter-board ground connector 41 are omitted from the mobile phone antenna of the third embodiment. The other components are the same as those of the third embodiment.

In the fifth embodiment, the bandwidth of mobile phones other than folding type mobile phone can be broadened.

Also, the mobile phone antenna in the first, second and third embodiment can be applied to mobile phones other than folding type mobile phone while removing the LCD ground 23 and the inter-board ground connector 41.

Although, in the first to fifth embodiments, the radiation element 10 is connected through the ground connector 42 to the board ground 32, the ground connector 42 may be connected to the LCD ground 23 or ground of the other electronic parts, mechanism parts (shielding cover, frame etc.)

Although the mobile phone antennas in the first to fifth embodiments are applied to mobile phone, they may be applied to PHS (personal handyphone system) mobile phone and PDA (personal digital assistant).

Although, in the first to fourth embodiments, the ground includes the LCD ground 23 and board ground 32, it may include one of them or more than two.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A mobile phone antenna, comprising:

a first conductive radiation element that is formed in a sheet metal conductor and resonates at a predetermined resonance frequency;

a second conductive radiation element that is formed in the sheet metal conductor and resonates at the predetermined resonance frequency; and a ground that is connected through a conductive ground connector with said second conductive radiation element;

wherein said ground is placed such that said ground is not opposed to said first and second conductive radiation elements, and wherein said second conductive radiation element functions as a ground, wherein said ground includes: a first ground that is connected through said conductive ground connector with said second conductive radiation element; and a second ground that is connected through a conductive inter-ground connector with said first ground, said second ground being capable of rotating in the range of a predetermined angle from a position that said second ground faces in parallel to said first ground, wherein said conductive inter-ground connector is positioned under said second conductive radiation element when said second ground rotates by said predetermined angle, wherein said conductive inter-around connector has a first bend portion at a first end thereof, a straight middle portion, and a second bend portion at a second end thereof, and wherein the first bend portion is directly connected to said first around and said second bend portion is directly connected to said second ground.

2. The mobile phone antenna according to claim 1, further comprising a third conductive radiation element, wherein said first conductive radiation element resonates at a first resonance frequency and said third conductive radiation element resonates at a second resonance frequency.

3. The mobile phone antenna according to claim 2, wherein said third conductive radiation element is disposed at right angle to a surface in which said first and second conductive radiation elements are formed.

4. The mobile phone antenna according to claim 3, wherein the third conductive radiation element has an L-shape that is inverted with respect to said first conductive radiation element that also has an L-shape.

5. The mobile phone antenna according to claim 2, wherein said second conductive radiation element includes: a first coupling adjuster that extends parallel to said first conductive radiation element while having a first clearance with said first conductive radiation element; and a second coupling adjuster that extends parallel to said third radiation element while having a second clearance with said third conductive radiation element; and said first and second coupling adjusters have a length, a width and said first and second clearances to be adjusted such that said mobile phone antenna has a predetermined resonance frequency and bandwidth.

6. The mobile phone antenna according to claim 5, wherein said first and second clearances are set 2 mm or less.

7. The mobile phone antenna according to claim 1, wherein said second conductive radiation element includes a coupling adjuster that extends parallel to said first conductive radiation element while having a predetermined clearance with said first conductive radiation element;

said coupling adjuster has a length, a width and said clearance to be adjusted such that said mobile phone antenna has a predetermined resonance frequency and bandwidth.

8. The mobile phone antenna according to claim 7, wherein said clearance is set 2 mm or less.

9. The mobile phone antenna according to claim 1, wherein the first ground is a board ground and the second ground is an LCD ground.

10. A mobile phone antenna for folding type mobile phone with a pair of housings foldable, comprising:

a first ground that is installed in one of said pair of housings;

a second ground that is installed in the other of said pair of housings, said second ground being connected through a conductive inter-ground connector with said first ground;

first and second conductive radiation elements that are disposed at a position where said first and second conductive radiation elements are not opposed to said first and second ground, said first and second conductive radiation element resonating at a predetermined resonance frequency; and a conductive ground connector that electrically connects said first ground with said second conductive radiation element, wherein said second conductive radiation element functions as a ground, wherein said second ground is capable of rotating in the range of a predetermined angle from a position that said second ground in parallel to said first ground, wherein said conductive inter-ground connector is positioned under said second conductive radiation element when said second ground rotates by said predetermined angle, wherein said conductive inter-ground connector has a first bend portion at a first end thereof, a straight middle portion, and a second bend portion at a second end thereof, and wherein said first bend portion is directly connected to said first ground and said second bend portion is directly connected to said second ground.

11. The mobile phone antenna according to claim 10, wherein said conductive ground connector has a first bend portion at a first end thereof, a straight middle portion, and a second bend portion at a second end thereof, and wherein the first bend portion is directly connected to said first ground and said second bend portion is directly connected to said second ground.

* * * * *